United States Patent [19]

Delfosse et al.

[11] 4,284,546

[45] Aug. 18, 1981

[54] COATING SUBSTANCES WITH A HIGH CONCENTRATION OF SOLIDS, FOR COATED PAPERS

[75] Inventors: Pierre Delfosse, Paris, France; Dieter Strauch, Zofingen, Switzerland

[73] Assignee: Omya S. A., Paris, France

[21] Appl. No.: 88,799

[22] Filed: Oct. 29, 1979

[30] Foreign Application Priority Data

Oct. 30, 1978 [FR] France ..... 78 30723

[51] Int. Cl.[3] ..... B05D 3/02; B05D 3/12; B32B 23/08; B32B 27/10

[52] U.S. Cl. ..... 260/29.6 R; 427/358; 427/361; 427/391; 428/514

[58] Field of Search ..... 427/391, 361, 358; 260/29.6 R; 428/514

[56] References Cited

U.S. PATENT DOCUMENTS

| | | | |
|---|---|---|---|
| 3,578,493 | 5/1971 | Smith | 427/391 X |
| 3,844,819 | 10/1974 | Windle | 427/361 |
| 4,010,307 | 3/1977 | Canard et al. | 427/391 X |

FOREIGN PATENT DOCUMENTS

| | | | |
|---|---|---|---|
| 2203909 | 5/1974 | France | 427/391 |
| 956778 | 4/1964 | United Kingdom | 427/391 |

*Primary Examiner*—Michael R. Lusignan

*Attorney, Agent, or Firm*—Neuman, Williams, Anderson & Olson

[57] ABSTRACT

A novel high-solids coating substance for coating paper and the like is provided. The coatings are in the form of solutions having pigment concentrations greater than 70%. The coatings provide high gloss and contain particles of calcium carbonate as substantially the only pigment.

3 Claims, No Drawings

COATING SUBSTANCES WITH A HIGH CONCENTRATION OF SOLIDS, FOR COATED PAPERS

The present invention relates to two new coating substances with a high concentration of solids, for coated papers (high-solid coatings).

By high-solid coatings, coated paper coating substances with a pigment concentration of more than 70% by weight which are used in the coated paper industry are meant.

High-solid coatings are already known. However, the known high-solid coatings are hardly every used since they have considerable disadvantages, particularly too high a viscosity. In addition, there are coating problems when they are used. These disadvantages are due in particular to the fact that the pigments used in these coating substances until now have had too high a concentration of ultrafine particles, i.e. particles which are smaller than 0.2 μm.

For the production of coated papers with the usual coating compounds or substances in a normal concentration of 58–60% of dry pigment, kaolin powders are generally used as the pigments, having the following characteristics: exceptional white coloration properties, great fineness (80% of the particles are smaller than 2 μm), increased covering capacity, and the ability to take printing well on a calendered on non-calendered coating.

The lamellar-type structure of kaolin, with a surface/thickness ratio of 4–8:1 in the case of American kaolin, and in the case of English kaolin up to 14–20:1, has a positive influence on the gloss of coated papers.

In addition to kaolin, however, other pigments are also used, such as satin white, and above all various types of calcium carbonate of natural origin (chalk, calcite (calc-spar), marble) or of industrial origin (precipitated calcium carbonates which are generally obtained by the effect of $CO_2$ on a lime solution). These pigments which are not kaolin must have two basic properties: a good level of fineness (at least 70% of the particles must be smaller than 2 μm) and good white coloration properties. The properties of fineness and white coloration capacity, however, are still inadequate to give the coated paper a satisfactory gloss when ultimately printed by the typographical or offset method.

For this reason, on the occasion of the TAPPI 78 (the annual Congress of the Technical Association of the Pulp and Paper Industry), in a paper under the title "Le developpement d'un carbonate de calcium fin pour le couchage du papier" ("The development of a fine calcium carbonate for coating paper") (pages 95–103), S. R. Dennison came to the conclusion: "It was clear that even very fine calcium carbonates could not be used as the only pigment in glossy coated papers. This has in fact never been anticipated."

In the following Table the comparative results which were obtained according to the state of the art with substances which contained 58% solids, this being either kaolin or natural calcium carbonate, are given. The components of the substances were (per 100 parts by weight of pigment) 14 parts by weight of styrene acrylate latex and 0.5 parts by weight carboxy methyl cellulose.

TABLE 1

| | Kaolin | Calcium Carbonate 1 | 2 | 3 |
|---|---|---|---|---|
| (A) Properties of the pigment and the coating substance | | | | |
| % smaller than 2 μm | | | | |
| Kaolin | 75 | — | — | — |
| nat. $CaCO_3$ | — | 90 | 89 | 70 |
| Pigment (parts by weight in coating substance) | | | | |
| Kaolin | 100 | 0 | 0 | 0 |
| nat. $CaCO_3$ | 0 | 100 | 100 | 100 |
| Viscosity of the coating substance (mPas/100 rpm) | 500 | 200 | 200 | 160 |
| (B) Properties of the coated paper | | | | |
| Gloss acc. TAPPI (75°–75°) % after conditioning, 50% rel. air humidity + 23° C. Supercalender 10 rollers 200 m/min Linear pressure 150 kg/cm Roller Temp. 60° C. | 51 | 31 | 35 | 24 |
| Print gloss acc. TAPPI % after conditioning (as above) Application 1.2 g/m² red | 67 | 55 | 57 | 45 |

Coating substances are also known which contain both kaolin and calcium carbonate and wherein the calcium carbonate contributes to improving certain properties of the paper and reducing the production costs. However, as might be anticipated, the gloss of the coated paper which is obtained according to the known process deteriorates increasingly as the carbonate content rises. In practice, it can be stated that the maximum acceptable proportion of calcium carbonate amounts to 30 parts per 70 parts of kaolin.

The following Table 2 shows the results obtained according to French Pat. No. 73 34 897, using ultrafine $CaCO_3$ pigments with a statistical average diameter of 0.5–0.9 μm and a specific surface of 12 $m^2/g$, compared with the use of kaolin. The coating is carried out with a wiper blade in the ratio of 12 $g/m^2$, at a speed of 800 m/min, followed by calendering with a machine comprising 12 rollers.

TABLE 2

| | Sample No. 1 | 2 | 3 | 4 | 5 |
|---|---|---|---|---|---|
| (A) Composition of the coating substance | | | | | |
| % by weight kaolin | 100 | 0 | 0 | 70 | 70 |
| % by weight nat. calcium carbonate (35% of particles <2 μm) | 0 | 100 | 0 | 30 | 0 |
| Nat. ultrafine calcium carbonate (80% of particles <2 μm) | 0 | 0 | 100 | 0 | 30 |
| Na polyacrylate (dispersion agent) | 0.3 | 0.4 | 0.4 | 0.4 | 0.4 |
| Styrene acrylate-latex | 12 | 12 | 12 | 12 | 12 |
| (B) Results | | | | | |
| Coated paper | | | | | |
| Square meter weight g/m² | 92 | 92 | 92 | 92 | 92 |
| Gloss acc. TAPPI % | 62 | 19 | 56 | 38 | 60 |
| Print Gloss with 1.2 g/m² printing ink % | 80 | 25 | 77 | 59 | 79 |

Processes are known for improving the gloss, in which higher concentrations of pigment are used in the coating substance (known as processing with high concentrations of solids or by the HCS method). By these processes, the lowest concentration level for the pigments in the coating substance is set at 70%. However, this HCS method comes up against certain difficulties with regard to the flow properties of the coating substances, since their viscosity is increased.

The flow behaviour of a pigment is the result of numerous factors (dispersion method, type and amount of the dispersing agent), and in particular, its structural properties, as well as the granulometric distribution of the pigment.

The lamellar-type structure of kaolin prevents low viscosities being achieved with high pigment concentration, and this problem becomes greater, the higher is the ratio of surface/thickness of the kaolin particles. For this reason, when it is used as the only pigment, kaolin cannot be used in a concentration of more than 66% in a coating substance, owing to its poor flow behaviour and the difficulty in spreading it under the blade. Moreover, it should be mentioned that improvement of the gloss with such concentrations can virtually be excluded, and that kaolin actually bestows its greatest possible gloss in normal concentrations (57–60%).

In the case of precipitated calcium carbonate, the particles of which are formed by rods, th flow behaviour depends mainly on its dispersion. The precipitated calcium carbonates which are sufficiently fine for use as coating substances for paper may not be dispersed in a concentration of more than 60% solid in a coating substance.

The situation is otherwise with the natural calcium carbonates, no matter what kind they are (calc-spar, chalk, marble). The rhomboid structure of these pigments allows high concentrations of solids in water. They disperse in a small amount of water, unlike pigments with lamellar-type structure (kaolin) or in the form of rods (precipitated carbonates), and they do so even with a minimal amount of dispersion.

It is therefore possible to obtain relatively stable concentrations of pigment in water, in the magnitude range of 75–78%. For coating substances it is absolutely vital to obtain aqueous suspensions of natural calcium carbonates with high concentrations of solids (76%). In order to obtain a coating substance with a minimum solid concentration of 70% (as in the HCS method) the pigment suspension must have a concentration of solids of at least 76%.

Comparison of the results which were achieved with two coating substances produced by the HCS method, which contained as the only pigment in one case kaolin and in the other case ultrafine natural calcium carbonate (90% of the particles smaller than 2 μm) shows, however, that with the carbonate less gloss was always obtained.

The following Table 3 shows the comparison between kaolin and the two natural calcium carbonates used as the only pigment according to the HCS method.

The composition of the coating substance amounts to 100 parts by weight of pigment per 14 parts by weight of styrene acrylate latex and 0.5 parts by weight of dispersing agent, but the concentrations of the coating substances were: 64% in the case of kaolin (in practice the maximum acceptable level for this pigment) and 70% in the case of the natural calcium carbonates.

TABLE 3

| | Kaolin | | Calcium Carbonates | | | |
|---|---|---|---|---|---|---|
| (a) Properties of the pigment and the coating substance | | | | | | |
| % particles smaller than: | | | | | | |
| 2 μm | 75 | | 90 | | 70 | |
| 1 μm | 55 | | 52 | | 28 | |
| Pigment (parts by weight in the coating substance) | | | | | | |
| Kaolin | 100 | | 0 | | 0 | |
| nat. $CaCO_3$ | | | 100 | | 100 | |
| Concentration of the coating substance (%) | 58 | 64 | 58 | 70 | 58 | 70 |
| (b) Properties of the coated paper | | | | | | |
| Gloss acc. TAPPI (75°–75°) % after conditioning, 50% rel. air humidity + 23° C. Supercalender 10 rollers 200 m/min Linear pressure 150 kg/cm Roller temp. 60° C. | 51 | 53 | 31 | 45 | 24 | 37 |
| Print gloss according to TAPPI % after conditioning (as above) Application 1.2 g/m² red | 67 | 68 | 55 | 62 | 45 | 50 |

As a whole, therefore, with regard to the gloss of the coated paper, the known methods show that:

1. In the case of a normal coating substance (58–60% solids) kaolin produces better results than the natural calcium carbonates or other industrial pigments (satin white, precipitated calcium carbonate, etc.), and this is irrespective of the fineness of these pigments.
2. With the HCS method, the use of kaolin is limited to concentrations of less than 66% and the normal or ultrafine calcium carbonates (up to 90% of the particles smaller than 2 μm) produce poorer results than those achieved with kaolin by the HCS method.

It appears, therefore, that the above-mentioned conclusion drawn by S. R. Dennison is fully confirmed, irrespective of the coating method used.

Mineral fillers are already known from DE-OS No. 28 08 425 which can be used without disadvantages for high-solid coatings. These mineral fillers ae characterized in that they are prepared by milling or grading according to particle size, and contain no particles which are smaller than 0.2 microns with an appropriate spherical diameter, or at all events only as few as possible, and maximally 15% by weight. In the DE-OS, precipitated calcium carbonate, dolomite, kaolin, talc, barium sulphate and/or quartz are recommended as mineral fillers. According to this DE-OS, mineral fillers which contain not more than 8% by weight of particles which are smaller than 0.2 microns with an appropriate spherical diameter, which have an upper section of 2–3 microns with an appropriate spherical diameter and which contain 80–95% by weight of particles which are smaller that 1 micron with an appropriate spherical diameter, are particularly advantageous.

The invention is based on the problem of creating a quite specific high-solids coating which gives coated papers with a particularly high gloss, this being a gloss of the same calibre or higher than that which can be achieved with coating kaolin.

After a protracted and extensive series of experiments, it was established according to the invention that this problem is solved surprisingly by a coating substance for coated papers which is characterised by the following features:

(a) it contains natural calcium carbonate as the only pigment,
(b) the percentage concentration of the calcium carbonate used amounts to 79.3% by weight, in water,
(c) the pH value of the calcium carbonate in water amounts to 9.5,
(d) the granulometric data of the calcium carbonate is:
% by weight of particles smaller than 2 μm=100
% by weight of particles smaller than 1 μm=82.5
% by weight of particles smaller than 0.2 μm=14
(e) the concentration of the coating substance in % by weight amounts to 72,
(f) it contains a synthetic binder, consisting of styrene acrylate latex in a quantity of 12 parts by weight per 100 parts by weight of calcium carbonate, calculated dry.

According to the invention the problem is also solved by a coating substance for coated papers which is characterised by the following characteristics:

(a) it contains natural calcium carbonate as the only pigment,
(b) the percentage concentration of the calcium carbonate used amounts to 79.3% by weight in water,
(c) the pH value of the calcium carbonate in water amounts to 9.5,
(d) the granulometric properties of the calcium carbonate are:

Upper section 2 μm

% by weight of particles smaller than 2 μm=100
% by weight of particles smaller than 1 μm=73
% by weight of particles smaller than 0.5 μm=30
% by weight of particles smaller than 0.2 μm=14
(e) the concentration of the coating substance in % by weight amounts to 72,
(f) the specific surface ($g/m^2$) of the calcium carbonate amounts to 71,
(g) it contains a synthetic binder, consisting of styrene acrylate latex in a quantity of 12 parts by weight per 100 parts by weight of calcium carbonate, calculated dry.

The natural calcium carbonates to be used according to the invention can be of different origin, the results being substantially identical for either basic substance. Examples are chalk (lime-containing coccolith), calcspar (cristalline structure) or white marble, all these materials being pulverised so that they possess the characteristics listed above. However, it is important that the minimum content of $CaCO_3$ in these materials amounts advantageously to more than 98.5%, so that any impurities which might be present do not prejudice these pigments detrimentally.

The said basic material can be in the dry state, e.g. in the form of a powder which has the characteristics according to the invention and it is made into an aqueous solution by normal means and in the presence of normal agents, before the preparation of the coating substance itself.

Suspension of a kind which is already known can also be used; these are thickened by evaporation in order to achieve the higher concentration required for the HCS method.

An important advantage of the high-solid coating according to the invention consists in the fact that considerable savings are possible in the amount of energy required for the drying process, and the amount of binder required is less. As far as the energy required for drying is concerned, the fact that instead of a 58% concentration for the coating substance, a concentration of 72% is used, means that there is a saving in the drying process of almost a third of the energy requirement of a couching plant.

As far as the amount of binder required is concerned, various factors are involved, such as the granulometry of the pigments and the penetration of the binder into the coated paper. In the case of a pigment for coating, the amount of binder required is generally a function of the mean diameter of the particles. The composition according to the invention ensures a good flow capacity and the smallest possible requirement for binder.

Moreover, the single pigment according to the invention, in the form of natural calcium carbonate, gives better properties than kaolin with regard to the extraction of moisture. This fact demonstrates that the amount of binder required for such a carbonate is less than for kaolin used for coating.

Finally, with the HCS method using the composition according to the invention there is a smaller amount of water present in the coating substance (maximum 30%), so that in view of the more rapid drying, it is more difficult for the binder to penetrate, which benefits the ability of the coated paper to take print.

The invention will be explained in more detail in the following with reference to Examples. The parts and percentage terms are parts by weight and percentages by weight respectively.

EXAMPLE 1

(According to the Invention)

An aqueous suspension (slurry) of a natural calcium carbonate (chalk) with 64% solid content is evaporated in a Delisel evaporator with a double casing until a pigment concentration of 79.3% is obtained. After the addition of 0.40 parts of an acrylic dispersion agent (per 100 parts carbonate) and after homogenisation, at 100 rpm a viscosity according to Brookfield of 850 mPas and a pH value of 9.5 is measured.

The synthetic binder consisting of styrene acrylate latex (Latex Acronal S 360 D) in a quantity of 12 parts by weight per 100 parts by weight of calcium carbonate, calculated dry, and a small amount of water as required, are then added in order to achieve a final concentration of 72% for the coating substance, the viscosity of which amounts to 760 mPas.

The coating is carried out according to the conditions described in Example 2, in a ratio of 16.8 $g/m^2$. The gloss of the product obtained is then determined.

Surprisingly, a gloss of 66% was obtained (measured according to TAPPI in the 75° incoming and outgoing beam angle, measured using a Gardner appliance).

Workers in the field can prepare the coated paper coating substance quite simply on the basis of the disclosed composition.

The coated paper coating substance according to the invention is prepared in the following way, for example:

The calcium carbonate 79.3% slurry is put into a high-speed mixer, and then a thickening agent, such as carboxy methyl cellulose, for example, is sprinkled in, then the styrene acrylate binder is added, possibly an optical brightner is added, and finally the pH is adjusted to 9.5 by means of NaOH or $NH_4OH$. After approximately 10 minutes mixing at a rotary speed of 1300 rpm, a coating substance is obtained with a viscosity of 300 mPas.

EXAMPLE 2

(Comparison Example)

An aqueous suspension with 70% solids is prepared from 100 parts by weight of kaolin Dinkie A in the presence of 0.22 parts of dispersing agent, and about 2.5 ml of soda per kg of kaolin is added in order to increase the pH value from 6.8 to 7.2. After processing in a high-speed turbine of the Rainery type at 1300 rpm, the Brookfield viscosity of the suspension, which was measured at 100 rpm, amounts to 300 mPas.

12 parts of Latex Acronal S 360 D was added, which made the pigment content fall to 65%, i.e. to the concentration limit of the kaolin coating substance. The viscosity of the substance then amounts to 550 mPas.

After this, the coating is carried out with a couching device according to Keegan, by the trailing blade method, where the blade is inclined at an angle of 45° to the coating roller. The pressure is adjusted for this so that a layer of 16.6 g/m$^2$ is produced. After this, the coated paper is conditioned for 48 hours at 20° C. with a relative air humidity of 65%, and then five runs are carried out through a calender at room temperature and with a linear pressure of 135 kg/cm.

After a further pause of 24 hours under the same conditions as before, the gloss of the paper was determined at an angle of 75° with a photovolt device. The values given correspond to the average of two measurements, one of which is taken in the longitudinal direction of the paper and the other in the transverse direction.

The results obtained are given in the following Table 4:

TABLE 4

| Pigment | Kaolin | Calcium Carbonate according to the invention (chalk) |
|---|---|---|
| % concentration of the pigment in water | 70 | 79.3 |
| pH value of the pigment in water | 6.8 | 9.5 |
| Granulometric characteristics of the pigment | | |
| % particles <2 μm | 75 | 100 |
| % particles <1 μm | | 82.5 |
| % particles <0.2 μm | | 14 |
| Concentration of the coating substance (in %) | 65 | 72 |
| Gloss of the coated paper (in %) | 58.5 | 66 |

The table shows clearly that with the use of the HCS method the composition according to the invention, which contains natural calcium carbonate as the only pigment, the granulometric characteristics of which correspond to the invention, produces a better gloss than the usual kaolin.

The other coated paper coating substance according to the invention, which is characterised above, was produced in a similar way, and its gloss was measured in the same way and compared with kaolin. The results are given in the following Table 5:

TABLE 5

| Pigment | Kaolin | Calcium Carbonate according to the invention (chalk) |
|---|---|---|
| % concentration of the pigment in water | 70 | 79.3 |
| pH value of the pigment in water | 6.8 | 9.5 |
| Granulometric characteristics of the pigment: | | |
| Upper section in μm | | 2 |
| % particles <2 μm | 75 | 100 |
| % particles <1 μm | | 73 |
| % particles <0.5 μm | | 30 |
| % particles <0.2 μm | | 14 |
| Concentration of the coating substance (in %) | 65 | 72 |
| Specific surface (g/m$^2$) of the pigment | 17 | 17 |
| Gloss of the coated paper (in %) | 58.5 | 63.5 |

The table clearly shows that, using the HCS method, the other composition according to the invention, which contains natural calcium carbonate as the only pigment, the granulometric characteristics of which correspond to the invention, produces a better gloss than the normal kaolin.

We claim:

1. A paper coating substance having a high solids content and containing natural calcium carbonate as substantially the only pigment; said calcium carbonate being in an aqueous form comprising 79.3% by weight of calcium carbonate; said aqueous calcium carbonate having a pH of about 9.5; all of the calcium carbonate particles being smaller than 2 μm; 82.5% by weight of said calcium carbonate particles being smaller than 1 μm; 14% by weight of said calcium carbonate particles being smaller than 0.2 μm; said coating substance containing a synthetic binder consisting essentially of a styrene-acrylate latex in an amount of 12 parts by weight per 100 parts by weight of said calcium carbonate calculated dry; the concentration of solids in said coating substance comprising about 72% by weight.

2. A paper coating substance having a high solids content and containing natural calcium carbonate as substantially the only pigment; said calcium carbonate being in an aqueous form comprising 79.3% by weight of calcium carbonate; said aqueous calcium carbonate having a pH of about 9.5; all of the calcium carbonate particles being smaller than 2 μm; 73% by weight of said calcium carbonate particles being smaller than 1 μm; 30% by weight of said calcium carbonate particles being smaller than 0.5 μm; 14% by weight of said calcium carbonate particles being smaller than 0.2 μm; said coating substance containing a synthetic binder consisting essentially of a styrene-acrylate latex in an amount of 12 parts by weight per 100 parts by weight of said calcium carbonate calculated dry; the concentration of solids in said coating substance comprising about 72% by weight; said calcium carbonate having a specific surface (g/m$^2$) of 17.

3. A paper coating substance according to claim 1 or claim 2, characterised in that the natural calcium carbonate is chalk.

* * * * *